United States Patent [19]

Iwao et al.

[11] 4,285,295

[45] Aug. 25, 1981

[54] FIXING DEVICE FOR ELECTROPHOTOGRAPHIC COPYING MACHINES

[75] Inventors: Soichi Iwao; Shinji Takiguchi; Toshio Sakata, all of Toyokawa, Japan

[73] Assignee: Minolta Camera Kabushiki Kaisha, Osaka, Japan

[21] Appl. No.: 76,738

[22] Filed: Sep. 18, 1979

[30] Foreign Application Priority Data

Sep. 19, 1978 [JP] Japan ..... 53-115378

[51] Int. Cl.[3] ..... B05C 11/00

[52] U.S. Cl. ..... 118/60; 118/101; 118/260; 118/DIG. 1; 219/216; 355/3 FU; 432/60; 432/228

[58] Field of Search ..... 118/260, 265, 624, 644, 118/661, 268, 706, 698, DIG. 1, 60, 101; 427/428, 429; 430/33, 98, 99, 124; 219/216; 355/3 FU; 432/60, 228

[56] References Cited

U.S. PATENT DOCUMENTS

| | | | |
|---|---|---|---|
| 2,774,326 | 12/1956 | Nelson | 118/706 |
| 3,359,938 | 12/1967 | Klemmer | 118/706 |
| 4,000,957 | 1/1977 | Ruhland | 118/DIG. 1 |
| 4,045,163 | 8/1977 | Menon | 118/60 |

*Primary Examiner*—Bernard D. Pianalto

*Attorney, Agent, or Firm*—Watson, Cole, Grindle & Watson

[57] ABSTRACT

A fixing device for an electrophotographic copying machine which includes a pair of rollers forming a nip therebetween through which the copy paper passes and an applicator which is capable of feeding a sufficient quantity of offset-preventing liquid only to the portion of the rollers where the leading end of the copy paper, will contact with the supply of offset-printing liquid to the remaining portion of the rollers being minimized to a quantity necessary for the preventing of offset. The consumption of offset-preventing liquid is reduced and the swelling of the silicone rubber coatings on the rollers, when used, is inhibited.

3 Claims, 9 Drawing Figures

FIXING DEVICE FOR ELECTROPHOTOGRAPHIC COPYING MACHINES

BACKGROUND OF THE INVENTION

The present invention relates to a fixing device for electrophotographic copying machines, and more particularly to a fixing device in which an offset preventing liquid is applied to the surface of a fixing roller.

With electrophotographic copying machines, the latent electrostatic image formed on a photconductive drum is converted by a developing unit to a toner image, which is then transferred onto copy paper by a transfer unit. The copy paper is pressed and heated by a fixing device comprising a pair of fixing rollers, whereby the toner image is fixed to the copy paper.

As shown in FIG. 1, the fixing device according to the prior art usually comprises an upper fixing roller 10 having a heater 11 in its interior and a thin silicone rubber coating 12 over the outer periphery thereof for preventing offset of the toner image during fixing, and a lower fixing (press) roller 13 having a thick silicone rubber covering 14 over its outer periphery. Upper fixing roller 10 is held in pressing (nip defining) contact with lower fixing roller 13, e.g., by a spring (not shown), to provide a nip of increased width and to produce an enhanced fixing effect. Silicone oil 15, which serves as an offset-preventing liquid, is fed by a felt 16 to an applicator roller 17, which in turn applies the oil to the upper fixing roller 10 to assure prevention of offset and separation of the copy paper 18 from the upper fixing roller 10. Copy paper 18 is fed to the nip between the upper and lower fixing rollers 10 and 13 to heat-fix the toner image thereto by the heater and is thereafter delivered onto a tray.

The fixing device described above has the following drawbacks.

(1) The silicone oil 15 for preventing offset, when applied to silicone rubber coating 12, swells the rubber coating and thereby results in a larger outside diameter of roller 10, causing the copy paper to travel at an increased speed and thus bringing the paper out of timed relation with the other paper feeding mechanisms. This causes damage to the copy paper or impairs the toner image thereon.

(2) With the rotation of upper fixing roller 10, the offset preventing liquid is automatically fed to this roller since felst16 is in contact with applicator roller 17 at all times. The device therefore consumes large quantities of silicone oil 15, which leads to a higher operating costs, irrespective of whether or not the silicone rubber coating is used.

(3) Toner particles, paper particles, etc., adhere to felt 16 during use, while felt 16 is merely in loose contact with applicator roller 17, so that the felt is likely to apply the silicone oil unevenly to the applicator roller. The silicone rubber coating and covering 12 and 14 will then be swollen unevenly, possibly causing damage to copy paper 18 or impairing the toner image thereon.

These drawbacks can be eliminated if silicone oil 15 is applied to upper fixing roller 10 only in a minimum amount needed for the prevention of offset as disclosed, for example, in U.S. Pat. No. 4,045,165.

Whereas this is useful for the prevention of offset, the exceedingly small amount of silicone oil 15 will permit the fixed copy paper 18 to travel with upper fixing roller 10 with its leading end fitting to the roller without being properly separated thereform by a separator pawl (not shown) subsequently disposed.

On the other hand, an attempt to assure proper separation invariably entails the foregoing drawbacks.

We have conducted various investigations on the drawbacks of the conventional fixing device described above with the following findings:

(1) Silicone oil, even if applied in a minimum quantity, is useful for the prevention of offset.

(2) The copy paper, once separated at its leading end only, can be wholly separated automatically without the necessity of using silicone oil specifically for the separation.

SUMMARY OF THE INVENTION

The main object of the present invention, which has been accomplished based on the above findings, is to provide a fixing device for electrophotographic copying machines in which a sufficient quantity of offset-preventing liquid is fed only to the portion needed for the separation of the leading end of copy paper, with the supply of offset-preventing liquid to the remaining portion minimized to a quantity necessary for the prevention of offset, so as to reduce the consumption of the offset-preventing liquid and to inhibit to the greatest possible extent the swelling of silicone rubber when the rubber coating is used.

To fulfill this objective, the present invention provides a fixing device which comprises a pair of fixing rollers and in which an offset-preventing liquid is applied to the surface of one of the fixing rollers, the fixing device being characterized by means for applying the offset-preventing liquid to the fixing roller positioned on the unfixed toner image-bearing side of the copy paper, and by means for driving the liquid-applying means to cause the liquid-applying means to supply the offset-preventing liquid only to the surface portion of the fixing roller where the leading end of the copy paper fits to the fixing roller, and to stop the supply of the offset-preventing liquid to the remaining portion of the fixing roller so that the supplied porton of the offset-preventing liquid is spread to a small thickness and covers the remaining portion.

DESCRIPTION OF THE PREFERRED EMBODIMENT

Figure 1:
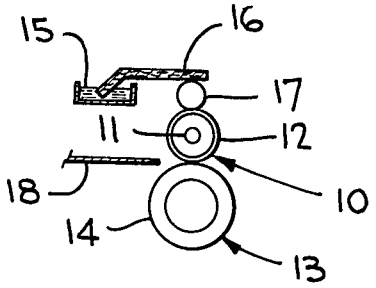
FIG. 1 (PRIOR ART)
FIG. 1 is a diagram in section illustrating a prior art fixing device.
Figure 2:
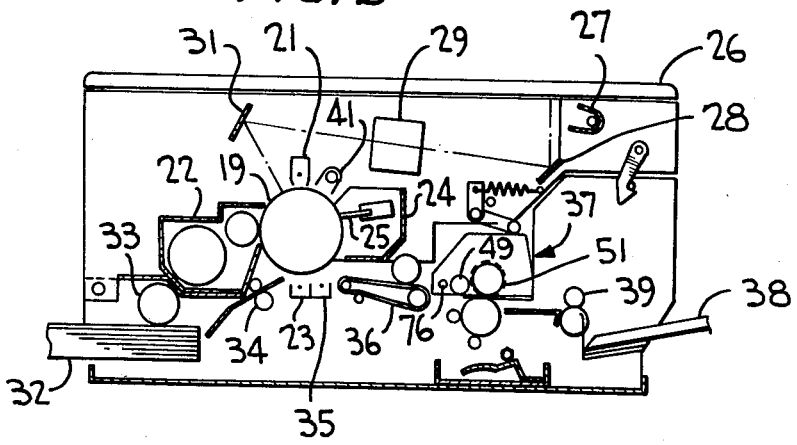
FIGS. 2 to 4 are diagrams showing an electrophotographic copying machine incorporating a fixing device embodying the invention and also illustrating the timing with which an offset-preventing liquid is supplied to the fixing device relative to the feed of copy paper to the device.
Figure 3:
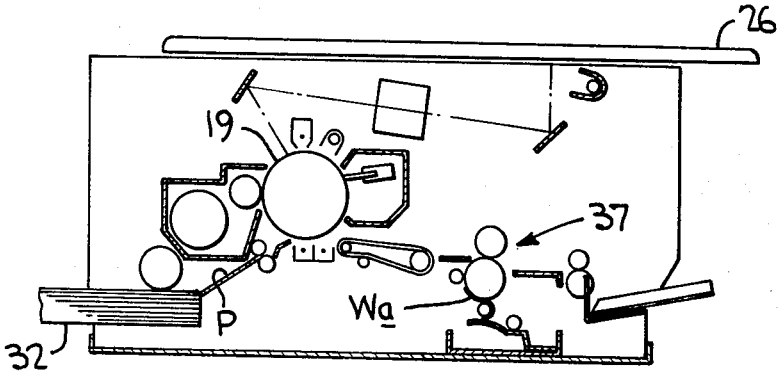
Figure 4:
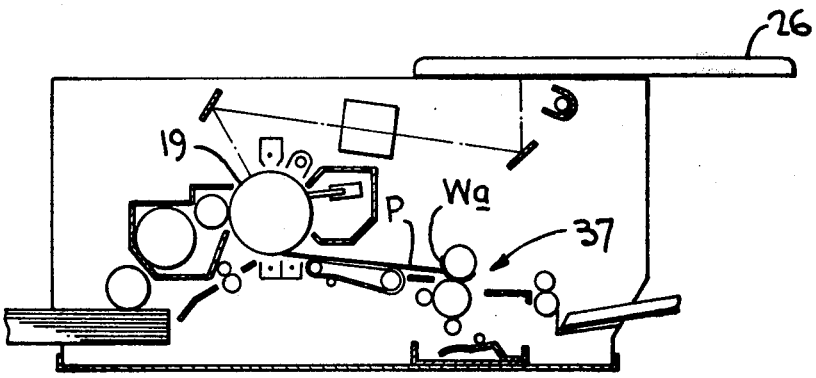

FIGS. 2 to 4 show a copying machine including a movable document carriage and a fixing device according to the present invention. Arranged around a photoconductive drum 19 are a sensitizing charger 21, a developing unit 22, a transfer charger 23, a cleaner 24 having a blade 25, etc., as already known. With the travel of carriage 26, the image of an original thereon is projected by an exposure lamp 27, a mirror 28, a lens 29 and a mirror 31 onto the surface of photoconductive drum 19 sensitized by charger 21. The latent electrostatic image thus formed is converted by developing unit 22 to a toner image, which is then transferred by transfer charger 23 onto copy paper P supplied from a cassette 32 to drum 19 by a feed roller 33 and a timing roller 34. Copy paper P is thereafter separated from drum 19 by a separator comprising an A.C. charger 35 and fed by a conveyor belt 36 to a fixing device 37, where the toner image is fixed. Copy paper P is discharged onto a tray 38 by a delivery roller 39.

The photoconductive drum 19 passing transfer charger 23 is cleaned by cleaner 24 and then erased with an eraser 41. The same operation as above is thereafter repeated.

Fixing device 37 is constructed in accordance with FIGS. 5 to 8 and essentially comprises an upper fixing roller 42, a lower fixing roller 43, a container 44 for an offset-preventing liquid and an assembly 46 for driving applying means 45.

Upper fixing roller 42 is of the known type having a thin silicone rubber coating 47 over the outer periphery thereof and a heater 48 in its interior. Roller 42 is rotatable in the direction of the arrow in FIG. 5 by a drive gear 49 meshing with a side gear 51 on roller 42.

Lower fixing roller 43 is also of the known type having a thick silicone rubber covering 52 over its outer periphery and is in pressing contact with upper fixing roller 42. Roller 43 is rotatable in the direction of the arrow in FIG. 5 by the rotation of the upper roller by virtue of the pressing contact.

Figure 5:
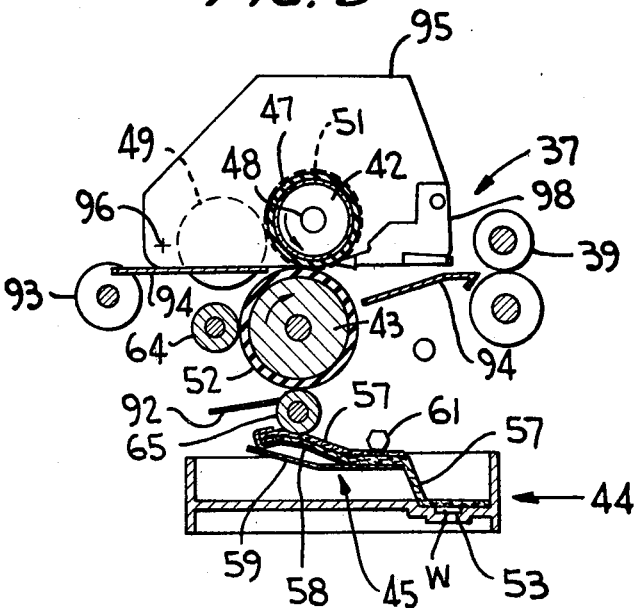
FIG. 5 is a diagram illustrating the fixing device.
Figure 6:
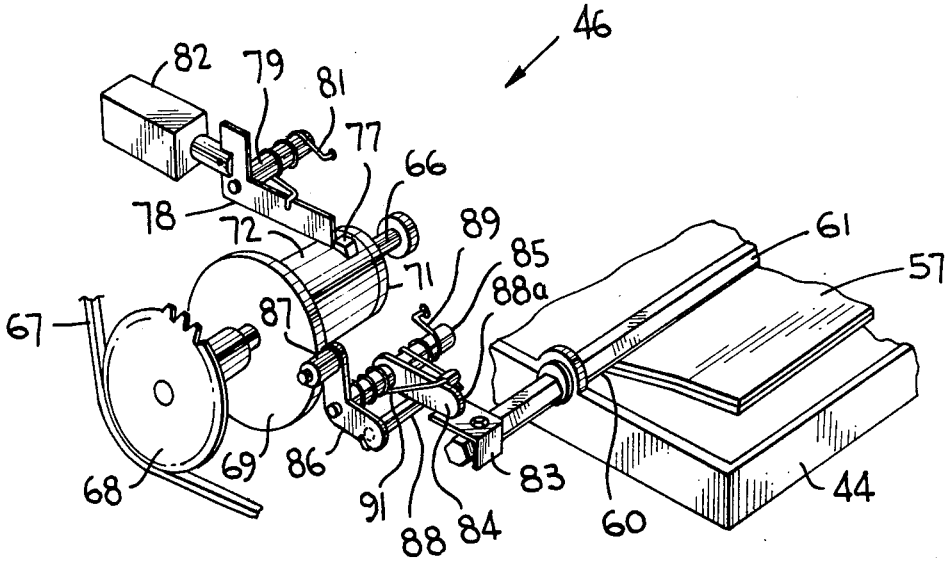
FIG. 6 is a perspective view showing a mechanism for driving means for applying the offset-preventing liquid.
Figure 8:
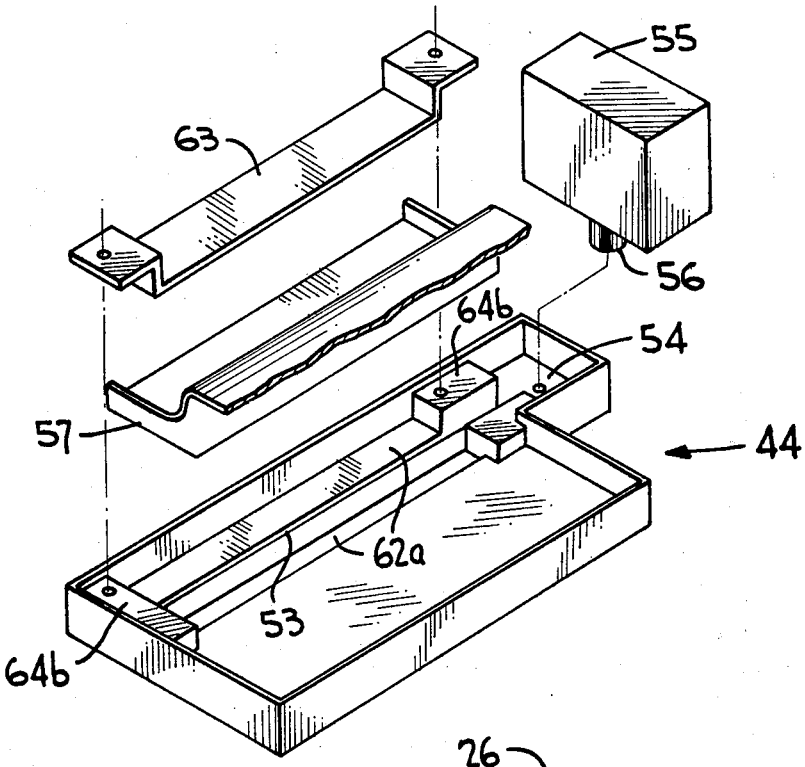
FIG. 8 is an exploded perspective view showing a container for the offset-preventing liquid.

As shown in FIGS. 5, 6 and 8, container 44 has an elongated groove 53 at one end of which there is provided a portion 54 for mounting a bottle 55 containing the offset-preventing liquid. Bottle 55 is of the known type having a cap 56 and a packing (valve) attached to the cap with a cap spring (not shown). The offset-preventing liquid is supplied to elongated groove 53 in a specified amount.

Means 45 for applying the offset-preventing liquid comprises an applicator felt 57 lined with a plate spring 58 over a large portion thereof, and an applicator plate 59 fixed to an applicator shaft 61. This shaft 61 is mounted on container 44 for rotation about a fixed axis and is rotatable by drive assembly 46 to be more fully described below. Plate 59 lies here with the felt and is fixed as at 60 to shaft 61 outwardly of opposite edges of the felt. Thus, that portion of the felt underlying an applicator roller 65 is movable toward and away from such roller respectively upon a clockwise and counterclockwise rotation of shaft 61.

One end portion of felt 57 where it is not provided with plate spring 58 is positioned on stepped portions 62*a*, 62*a* on opposite sides of groove 53 of container 44 and is held in place by a felt holder 63 which is fastened to seats 64*b*, 64*b* with unillustrated screws. The felt end portion covers elongated groove 53, absorbs the offset-preventing liquid W in contact therewith and confines the liquid W in container 44 even when the container is inclined. A leveling roller 64 and applicator roller 65 serving as components of applying means 45 are arranged around lower fixing roller 43. The other end of applicator felt 57 is positioned under applicator roller 65.

Figure 7:
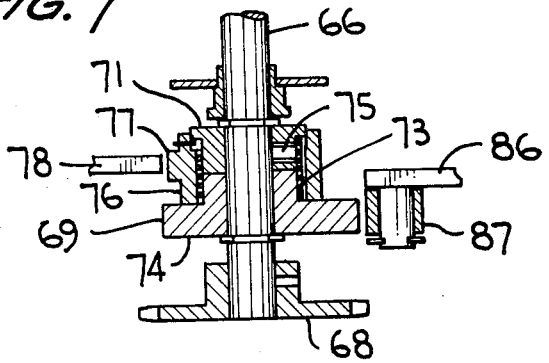
FIG. 7 is a fragmentary view in section showing the mechanism of FIG. 6.

Drive assembly 46 for applicator shaft 61 includes a clutch mechanism mounted on a shaft 66 of delivery roller 39 as seen in FIGS. 6 and 7. A chain 67 driven by unillustrated drive means is in engagement with a drive sprocket wheel 68 mounted on shaft 66. The clutch mechanism comprises a cam 69, a clutch ring 71, a clutch-actuating ring 72 and a clutch spring 73. Cam 69 has a boss portion 74 rotatably mounted on roller shaft 66. Clutch ring 71 is fixed to roller shaft 66 by a screw 75. Clutch spring 73 is tightly fastened around clutch ring 71 and boss portion 74. To release clutch ring 71 from spring 73, a free bent end of spring 73 toward the clutch ring is engaged with clutch-actuating ring 76 around spring 73. The other end of spring 73 is fixedly positioned by being engaged in a bore (not shown) in boss portion 74 of cam 69. A projection 77 is integrally formed on the outer periphery of clutch-actuating ring 72. A clutch-operating lever 78 disposed above ring 76 is engageable with projection 77. Lever 78 is disengaged from projection 77 when turned about a rod 79 against a return spring 81 on energization of a solenoid 82.

When roller shaft 66 is in rotation while clutch-operating lever 78 is out of engagement with projection 77, clutch spring 73 exerts a fastening force on clutch ring 71 and thereby causes cam 69 to rotate with ring 71. Whereas, while lever 78 is in engagement with projection 77, clutch spring 73 which fits around clutch ring 71 is unwound, thereby permitting cam 69 to rotate relative to roller shaft 66 and remain stationary.

An applicator shaft lever 83 is attached to one end of applicator shaft 61. An intermediate lever 84 rotatably supported on a fixed rod 85 is positioned on the upper surface of applicator shaft lever 83. An applicator-operating lever 86, which is similarly rotatably mounted on one end of fixed rod 85, has at its one end a roller 82 in pressing contact with cam 69. Applicator-operating lever 86 is provided at its other end with a stopper 88 extending laterally to support the lower edge of intermediate lever 84. A spring 89 wound on fixed rod 85 has one end attached to the main body and its other end in engagement with free end 88*a* of stopper 88. At all times, spring 89 biases intermediate lever 84 away from shaft lever 83 while urging roller 87 on applicator operating lever 86 into contact with cam 69. On the other hand, an applicator spring 91 wound around fixed rod 85 is provided between applicator operating lever 86 and intermediate lever 84 to cause the intermediate lever to follow the movement of cam 69.

It is now assumed that roller shaft 66 is in rotation and also cam 69 is in rotation. When applicator-operating lever 86 turns clockwise in FIG. 6, with roller 87 following the cam face under the action of spring 89, intermediate lever 84 made turnable with operating lever 86 by applicator spring 91 also turns clockwise so as to cause shaft 61 to rotate (counterclockwise in FIG. 6 and clockwise in FIG. 5), bringing the forward end of felt 57 into pressing contact with applicator roller 65 to thereby feed silicone oil W to roller 65. On the other hand, roller 87, when engaging in a recess of cam 69 (i.e., when the cam edge recedes from rod 85), causes spring 89 to turn intermediate lever 84 counterclockwise in FIG. 6. With this movement, applicator shaft lever 83, which is biased by an unillustrated spring, returns felt 57 clockwise to stop the supply of silicone oil W to applicator roller 65.

Indicated at 92 in FIG. 5, is a blade by which any silicone oil remaining on applicator roller 65 is scraped off and returned to container 44. A roller 93 is provided for feeding copy paper P to fixing device 37 after the transfer of toner images, and a guide plate 94 is provided for copy paper P.

Upper fixing roller 42 is mounted on a fixing frame 95 pivotally mounted at 96 to a main body lower frame 97 as more fully described below. A separator pawl 98 is attached to fixing frame 95.

Figure 9:
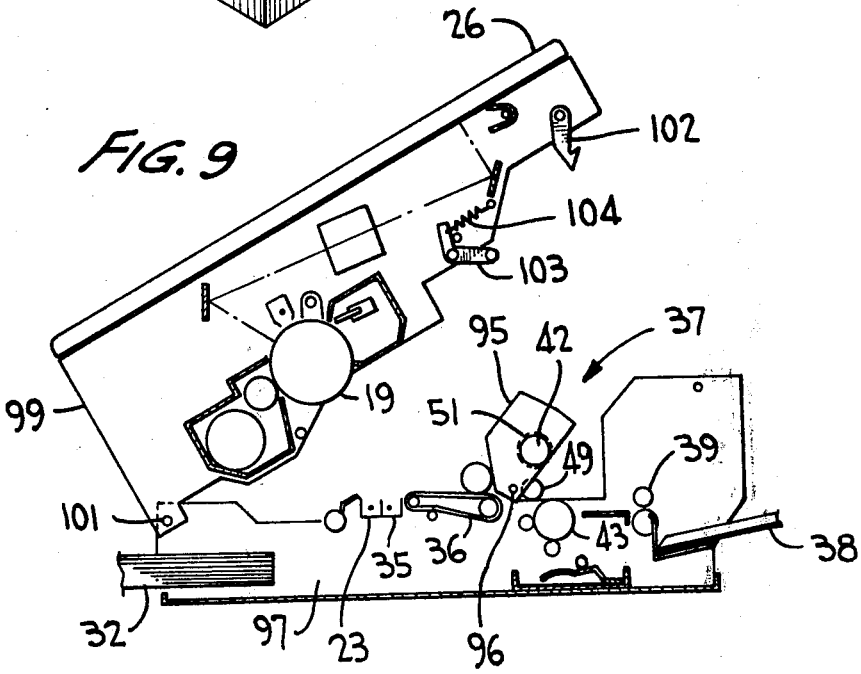
FIG. 9 is a diagram showing the copying machine of FIG. 2 with its main body upper frame in an opened condition.

The main body of the copying machine comprises an upper frame 99 and the aforementioned lower frame 97 as shown in FIG. 9. Main body upper frame 99 is pivotally mounted as at 101 on lower frame 97 so that it may be opened relative thereto to render the interior of the machine easily accessible, for example, in the event of a paper jam.

Photoconductive drum 19, charger 21, developing unit 22, cleaner 24, eraser lamp 41 and the optical system are installed in upper frame 99, while cassette 32, transfer charger 23, separating A.C. charger 35, conveyor belt 36, fixing device 37, drive gear 49 and tray 38 are mounted on lower frame 97. Frames 99 and 97 can be interlocked together by a lock lever 102.

A substantially L-shaped lever 103 for pushing the fixing device is pivoted to upper frame 99 and has one end pulled by a spring 104 and the other end projecting from the upper frame. When upper frame 99 is closed, lever 102 pushes fixing frame 95 bringing upper fixing roller 42 into pressing contact with lower fixing roller 42 with drive gear 49 (see FIGS. 2 and 5). When upper frame 99 is in its opened position, frame 95 can be opened by hand. Frame 95 when opened, interrupts the transmission of torque to upper fixing roller 42, making fixing device 37 easy to handle, for example, for removing jammed paper (see FIG. 9).

The copying machine of the above construction performs a fixing operation in the following manner.

On depression of the print button (not shown), document carriage 26 travels, while a sheet of copy paper P is sent out from cassette 32. Simultaneously with this, for example, solenoid 82 of fixing device 37 is energized to initial rotation of cam 69. The copy paper P having a toner image transferred thereto from photoconductive drum 19 by transfer charger 23 is fed to fixing device 37 by conveyor belt 36.

On the energization of solenoid 82, the rotation of cam 69 turns applicator shaft 61 clockwise in FIG. 5, bringing felt 57 into pressing contact with applicator roller 65 rotating with upper fixing roller 42 to apply the silicone oil W to roller 65 as illustrated. When applicator roller 65 has rotated one turn with the silicone oil W applied to its outer periphery, roller 87 reaches the recessed portion of cam 69, returning felt 57 to the initial position. At the same time, solenoid 82 is de-energized to engage clutch-operating lever 78 with projection 77. Cam 69 thereafter remains stationary as already described.

The silicone oil W applied to applicator roller 65 by felt 57 is fed to lower fixing roller 43 in an amount Wa corresponding to the circumferential length of applicator roller 65. The amount of silicone oil Wa is uniformly leveled by roller 64 and is applied to upper fixing roller 42.

The silicone oil on applicator roller 65 is not wholly fed to lower fixing roller 43 but partly remains on roller 65. The remaining oil is scraped off by blade 92 and is collected in container 44.

When upper fixing roller 42 has rotated about two turns with the silicone oil W applied thereto, the leading end of copy paper P is fed to portion Wa of roller 42 to which the silicone oil W was first applied.

It can be seen in FIG. 4 that the portion of upper fixing roller 42 indicated at Wa is coated with a relatively large amount of silicone oil W.

The quantity of silicone oil Wa corresponding to the circumferential length of applicator roller 65 and fed to lower fixing roller 43, when leveled by roller 64, is partly transferred to roller 64, then applied to lower fixing roller 43 and subsequently to upper fixing roller 42. Additionally the silicone oil W is also spread over upper fixing roller 42. Consequently, the portion of roller 42 other than the portion Wa bears only a small amount of silicone oil W. Thus the leading end of copy paper P is pressed against upper fixing roller 42 at the portion coated with the relatively large quantity of silicone oil Wa and can therefore be properly separated from roller 31 by separator pawl 98, while offset on upper and lower fixing rollers 42 and 43 can also be prevented. The presence of a small amount of silicone oil W further prevents the rearward end portion of copy paper P from causing offset on upper and lower fixing rollers 42 and 43. Copy paper P is smoothly discharged from the machine by delivery roller 39 which forcibly pulls the leading end of copy paper P.

Stated more specifically, the copying machine operates under the following conditions.

The diameters of rollers 65, 43 and 42 and their circumferential lengths (in parentheses) are:

Applicator roller 65 . . . 15 mm (47.1 mm)
Lower fixing roller 43 . . . 40 mm (125.7 mm)
Upper fixing roller 42 . . . 32 mm (100.5 mm)

The combined distance of the movements involved is 328 mm, including:

Distance of preliminary travel of document carriage 26 . . . 37 mm
Distance of rotation of drum 19 from exposure station to transfer station . . . 101 mm
Distance of travel of copy paper P from transfer station to upper fixing roller 42 . . . 190 mm Copy paper P is fed at a speed of 109.96 mm/sec.

The time taken for copy paper P to come into contact with upper fixing roller 42 after the start of document carriage 26 is 328/109.96, namely 2.98 sec. The portion of silicone oil W applied to applicator roller 65 by felt 57 during one turn (47.1/109.96, namely 0.43 sec) of roller 65 after the start of document carriage 26 is fed from lower fixing roller 43 to upper fixing roller 42. The leading end of the portion of silicone oil fed by applicator felt 57 revolves about two turns on the upper fixing roller 42 and, 2.98 sec later, is at a position 42.35 mm (smaller than 47.1 mm, the circumferential length of the applicator roller) ahead of the point of contact between upper and lower fixing rollers 42 and 43.

Accordingly, copy paper P is subjected to a fixing operation with its leading end positioned at the portion of upper fixing roller 42 to which silicone oil W is applied initially.

Although the leading end of copy paper P is adapted to be positioned at the above-mentioned roller portion Wa of initial application after upper fixing roller 42 has been rotated about two turns according to the embodiment described, copy paper P is similarly positionable if the amount of rotation of roller 42 before the feed of the paper is altered variously.

While the silicone oil is fed by applicator roller 65 to lower fixing roller 43 with the foregoing embodiment, the oil may be applied to upper fixing roller 42. Furthermore the timing with which copy paper P is fed to upper and lower fixing rollers 42 and 43 can of course be determined by different means.

With the fixing device of the aforedescribed invention, the offset-preventing liquid usually used in such devices is applied only to the surface portion of the upper fixing roller where the leading end of unfixed toner image bearing copy paper is to be positioned, whereas the liquid is spread to the other portion in a minimum quantity needed for the prevention of offset. The device therefore uses a reduced amount of the offset-preventing liquid and is economical. The offset-preventing liquid coating the fixing rollers, which is smaller than is conventionally needed in overall quantity, is less likely to swell the fixing rollers even when the rollers are covered for example with silicone rubber, whereas the leading end of the copy paper can be separated as smoothly as in the conventional devices without damage to the paper or deterioration of copy images.

Obviously, many modifications and variations of the present invention are made possible in the light of the above teachings. It is to be therefore understood that within the scope of the appended claims the invention may be practiced otherwise than as specifically described.

What is claimed is:

1. A fixing apparatus for use with an electrophotographic copying machine, said fixing apparatus being capable of fixing an unfixed toner image on a copy paper passing therethrough, said fixing apparatus including a pair of rotatable fixing rollers which are mounted so as to be capable of being positioned in nip-defining contact, a copy paper having an unfixed toner image on one side being capable of passing therebetween, and an applicator means for intermittently applying a predetermined quantity of offset-preventing liquid to one of said fixing rollers, said applicator means including an applicator roller in contact with the surface of said one fixing roller, a supply tank containing offset-preventing liquid, a movable feeding device capable of intermittently supplying offset-preventing liquid from said supply tank to said applicator roller, and drive means for moving said feeding device, said applicator means supplying offset-preventing liquid to said one of said fixing rollers such that upon rotation of said fixing rollers a large amount of offset-preventing liquid will be located on the roller intended to contact the side of the copy paper having the unfixed toner image at the portion thereof where the leading edge of the copy paper will be positioned so as to facilitate separation therebetween, whereas a lesser amount of offset-preventing liquid will be located on the remaining portion of said roller intended to contact the side of the copy paper having the unfixed toner image thereon.

2. The fixing apparatus as defined in claim 1, wherein said applicator roller has a smaller diameter than the diameter of said one fixing roller in which it is in contact, wherein a blade means is in contact with the surface of said applicator roller to control the amount of offset-preventing liquid thereon, wherein a leveling roller is in contact with the surface of said one fixing roller, and wherein said drive means for moving said feeding device operates such that said movable feeding device supplies offset-preventing liquid to said applicator roller during one rotation of said applicator roller only.

3. The fixing apparatus as claimed in claim 1, wherein said feeding device comprises a felt.

* * * * *